US007013591B2

(12) United States Patent
Lee

(10) Patent No.: US 7,013,591 B2
(45) Date of Patent: Mar. 21, 2006

(54) ADORNMENT FOR PHOTOGRAPH OR PICTURE DISPLAY AND METHOD OF MANUFACTURING THE SAME

(76) Inventor: Eun Woo Lee, Ssang yong Apt. 503-803, Blue village Sunae-dong, Bundang-gu, Soongnam-city, Kyunggi-do (KR)

( * ) Notice: Subject to any disclaimer, the term of this patent is extended or adjusted under 35 U.S.C. 154(b) by 0 days.

(21) Appl. No.: 10/895,305

(22) Filed: Jul. 21, 2004

(65) Prior Publication Data

US 2005/0055858 A1 Mar. 17, 2005

(30) Foreign Application Priority Data

Sep. 17, 2003 (KR) ..... 10-2003-0064308

(51) Int. Cl.
*G09F 1/12* (2006.01)

(52) U.S. Cl. ..... 40/800; 40/124.191

(58) Field of Classification Search ..... 40/800, 40/124.08, 124.09, 124.191, 594
See application file for complete search history.

(56) References Cited

U.S. PATENT DOCUMENTS 3,057,099 A * 10/1962 Fruchter ..... 428/13
3,897,645 A * 8/1975 Scheyer ..... 40/800
5,261,172 A * 11/1993 Rowley ..... 40/124.08
5,282,914 A * 2/1994 Spendlove ..... 156/227
5,388,353 A * 2/1995 Givnan ..... 40/737
5,715,795 A * 2/1998 Guentert et al. ..... 123/467

* cited by examiner

*Primary Examiner*—Cassandra Davis
(74) *Attorney, Agent, or Firm*—Park Law Firm; John K. Park

(57) ABSTRACT

An adornment for photograph or picture display is provided. The adornment includes a draft sheet including a draft with various figures, shapes and colors on a back plate; a plurality of picture sheets including a plurality of pictures to be three-dimensionally accumulated on the draft of the draft sheet; and a sticker sheet including a releasable sheet attached to each of both surfaces thereof and a plurality of stickers with various sizes, plurality of representations provided on both the draft and the pictures, each of which indicates a position at which each of the stickers is attached; and attachment number representations individually provided on the pictures and having an identical serial number to that on the draft, thus allowing each of the pictures to be attached to the draft in such a way that each of the pictures matches the draft.

1 Claim, 7 Drawing Sheets

ADORNMENT FOR PHOTOGRAPH OR PICTURE DISPLAY AND METHOD OF MANUFACTURING THE SAME

CROSS REFERENCE RELATED TO THE APPLICATION

The applicant claims and requests a foreign priority, through the Paris Convention for the Protection of Industry Property, based on a patent application filed in the Republic of Korea (South Korea) with the filing date of Sep. 17, 2003, with the patent application number 10-2003-0064308, by the applicant. (See the Attached Declaration)

BACKGROUND OF THE INVENTION

1. Field of the Invention

The present invention relates, in general, to an adornment for photograph or picture display and a method of manufacturing the adornment. More particularly, the present invention relates to an adornment capable of displaying three-dimensionally and beautifully a photograph or a picture attached thereto or inserted thereinto and is thus useful as an interior adornment, and a method of manufacturing the adornment.

2. Description of the Prior Art

Typically, frame assemblies or albums are used for storing or displaying pictures or photographs. In case of using a frame assembly, a picture or photograph is placed on a back plate and prevented from being moved by an adornment fixing board installed at the borders of the back plate, and a frame with a transparent glass or synthetic resin panel is then joined to the front surface of the back plate. The album is a book with many pages on which transparent synthetic resin films are provided, and photographs are stored in the album or displayed on the pages thereof by being covered with the transparent synthetic resin films.

Recently, pictures or photographs have been ornamented with various figures and shapes that lie around the pictures or photographs for their conspicuous storage or display. For example, an adornment for picture or photograph display applied by the present applicant can be used, which comprises a frame with a transparent glass or synthetic resin panel, a back plate having a draft and to be joined to the frame, and a plurality of adornment picture plates including pictures identical to the draft. In this adornment, the adornment picture plates are accumulated on the back plate with predetermined intervals using balls and synthetic resin bars coated with an adhesive, thereby allowing three-dimensional and ornamental display of a picture or photograph inserted thereinto.

However, in case of the aforementioned adornment for picture or photograph display, the balls or synthetic resin bars, which are used to immobilize the adornment picture plates accumulated on the draft of the back plate with the predetermined intervals, are individually at their both ends coated with the adhesive. One end of the balls or bars is attached to the front surface of the draft or an adornment picture plate previously accumulated on the draft, and the other is attached to the bottom surface of a newly accumulated adornment picture plate.

Since each of the balls or synthetic resin bars should be manually coated with the adhesive each time when the adornment picture plates are accumulated, the assembly of the aforementioned adornment is cumbersome and complicated. Also, the adornment is problematic in terms that its assembly is a time-consuming process because the applied adhesive sticks to the hands of persons executing the assembly, and the hands thus adhere to the adornment picture plates upon their accumulation, thereby making it difficult to accumulate the adornment picture plates.

The adornment is further problematic as follows. When the adhesive is used in an amount higher than being required, the surplus adhesive is solidified around a site at which the ball or synthetic resin bar is attached to the adornment picture plate, thereby damaging the appearance of the adornment.

The problems further include that, when the adornment picture plates are desired to be accumulated with various size, positions and heights for more three-dimensional display thereof, they are difficult to be arranged on the front surface of the back plate while maintaining proper heights because the balls or synthetic resin bars do not have marks for attachment positions or accumulation heights of the adornment picture plates.

Therefore, users must carefully execute the assembly of the aforementioned adornment while attaching the balls or synthetic resin bars to the draft or adornment picture plates with proper intervals according to the sizes of the adornment picture plates. When the adornment picture plates are not accumulated with proper intervals, the assembled adornment fails to three-dimensionally display the pictures.

SUMMARY OF THE INVENTION

It is therefore an object of the present invention to provide an adornment for three-dimensional and beautiful display of a photograph or picture attached thereto or inserted thereinto, which is capable of being used as an interior adornment.

It is another object of the present invention to provide an adornment allowing for any one to easily achieve three-dimensional and beautiful display of a photograph or picture attached thereto or inserted thereinto and having an educational effect of developing children's ability to display themselves the picture or photograph.

It is a further object of the present invention to provide an adornment in a frame or card form, which is capable of displaying a photograph or picture in a three-dimensional beautiful space.

To achieve the above objects, the present invention provides an adornment for photograph or picture display, including a draft sheet having a draft with various figures, shapes and colors on a back plate with a predetermined size; a plurality of picture sheets including a plurality of pictures with various figures and shapes to be three-dimensionally accumulated on the draft of the draft sheet; and a sticker sheet including a releasable sheet attached to each of both surfaces thereof and a plurality of stickers with various sizes to mediate accumulation of the plurality of pictures on the draft of the draft sheet with predetermined heights.

The sticker sheet is characterized by being punched to provide the stickers according to the sizes of both the draft of the draft sheet and the pictures of the plurality of picture sheets.

The stickers are characterized by having a circular shape.

The draft sheet also includes a plurality of representations on the draft, each of which indicates a position at which each of the stickers is attached for the accumulation of any one of the pictures of the plurality of picture sheets.

Each of the plurality of representations is marked with the number of the stickers, which corresponds to the accumulation height of each of the pictures of the plurality of picture sheets.

The draft sheet further includes a photograph attachment presentation to indicate a position at which a picture or photograph to be displayed is attached.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
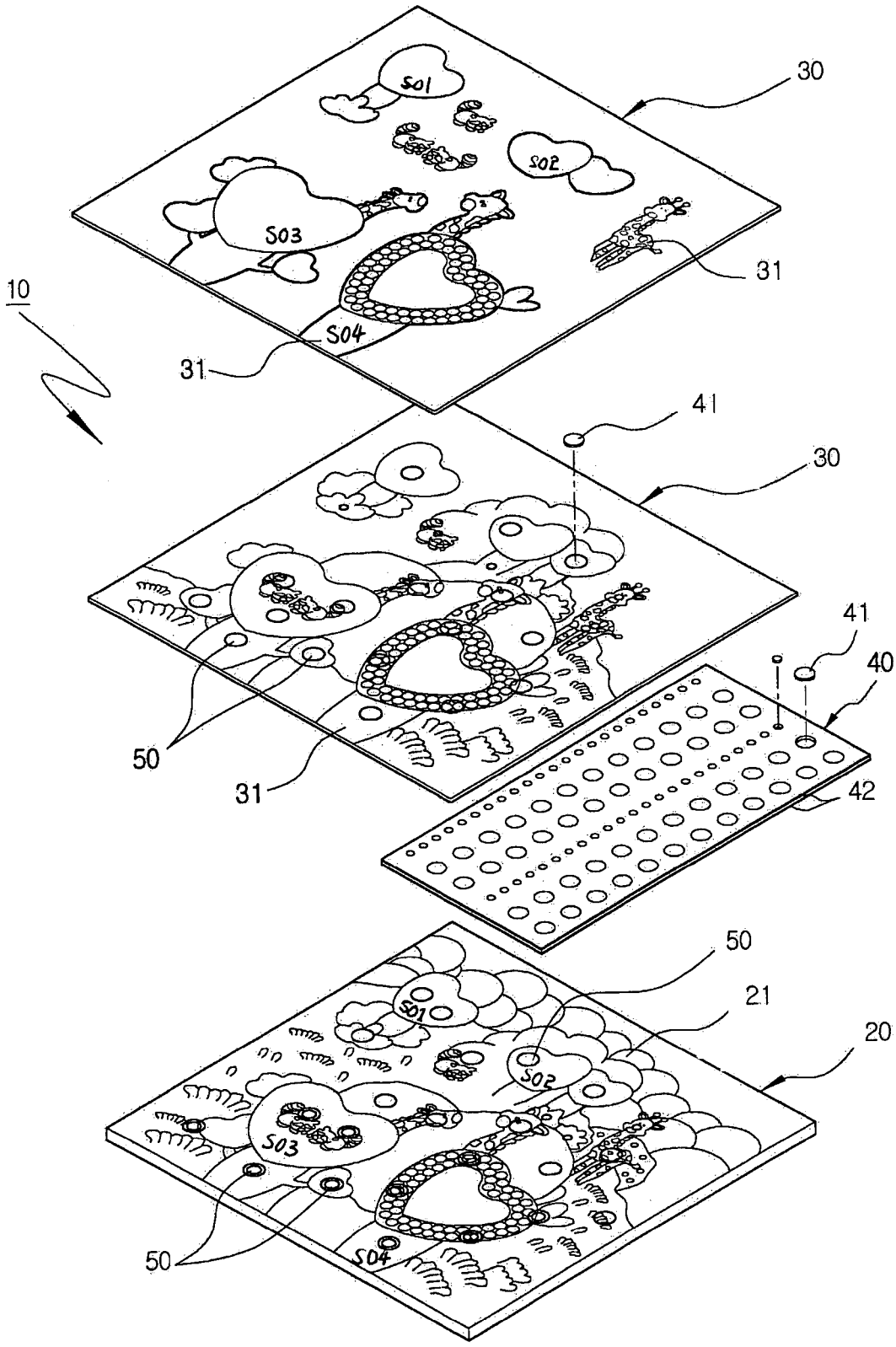
FIG. 1 is a perspective view showing an adornment for photograph or picture display according to an embodiment of the present invention.
Figure 2A:
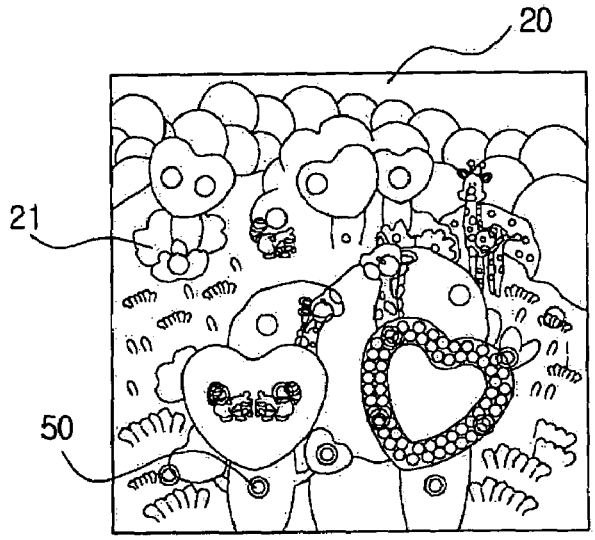
FIGS. 2*a* to 2*e* are top plan views of a draft sheet and a plurality of picture sheets of the adornment according to the present invention.
Figure 2B:
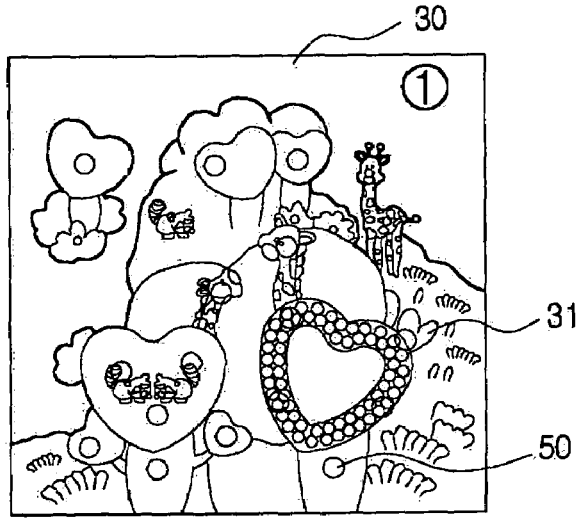
Figure 2C:
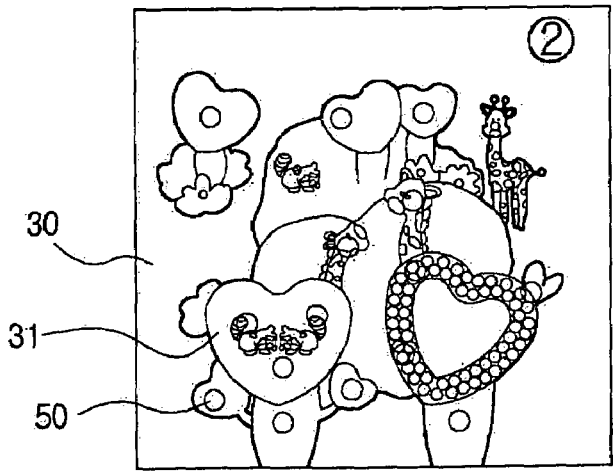
Figure 2D:
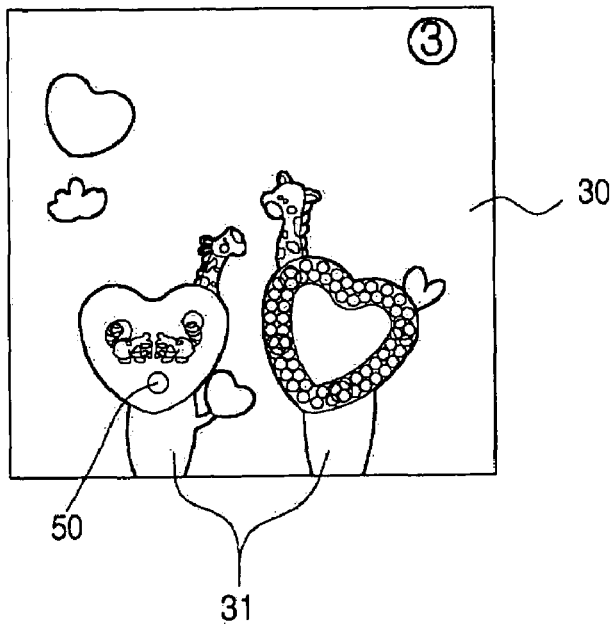
Figure 2E:
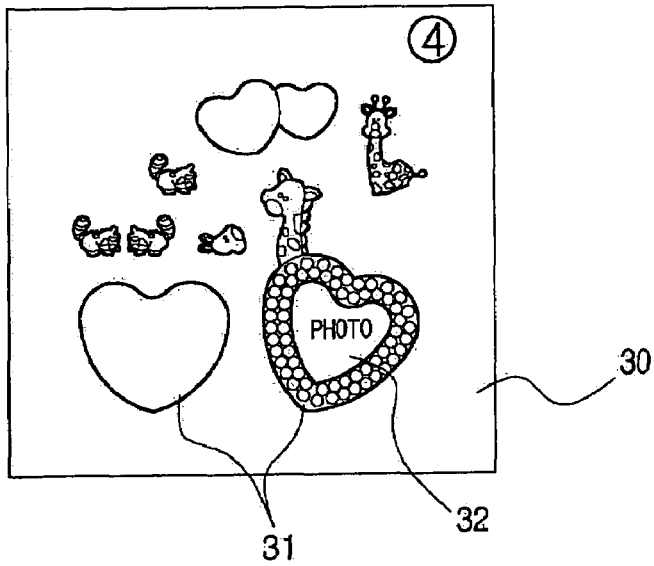

FIG. 1 is a perspective view of an adornment for photograph or picture display according to an embodiment of the present invention. The adornment 10 for photograph or picture display is manufactured by a process comprising: preparing a draft sheet 20 having a draft 21 with various figures, shapes and colors on a back plate with a predetermined size; preparing a plurality of picture sheets 30 including a plurality of pictures 31 with various figures and shapes to be three-dimensionally accumulated on the draft 21; and preparing a sticker sheet 40 including a releasable sheet attached to each of both surfaces thereof and a plurality of stickers 41 with various sizes to mediate accumulation of the plurality of pictures 31 on the draft 21 of the draft sheet 20 with predetermined heights.

At the step of preparing the draft sheet 20, the draft sheet 20 is made of a board having a certain size and being as thick as being not easily bent or folded, and is printed or directly drawn with the draft 21 having various figures, shapes and colors, thereby providing the draft sheet 20.

At the step of preparing the plurality of picture sheets 30, the plurality of pictures 31 with various figures and shapes are provided in such a way to be accumulated on the draft 21 drawn on the back plate 10 of the draft sheet 20 and to three-dimensionally display the draft 21.

The plurality of picture sheets 30 may be prepared by using papers of various textures. The pictures 31 drawn on the plurality of picture sheets 30 have individually a dotted line around it, and are thus easily removed from the plurality of picture sheets 30.

The plurality of picture sheets 30 are formed in about three to five sheets for the draft 21 of the draft sheet 20, and marked with a sequential number or sign to allow a user to easily find a desired or next sheet from the plurality of sheets. In addition, to allow a desired picture matching the draft 21 to be easily found among the pictures 31, each of the pictures 31 of the plurality of picture sheets 30 is marked with an identical serial number to that provided on the draft 21 of the plurality of draft sheets 20, thereby forming attachment number representations. Referring to FIG. 1, the identical serial numbers SO1, 502, S03and S04 are shown to illustrate that the identical serial numbers are used to match the pictures 31 to the draft 21.

One or more of the plurality of pictures 31 of the plurality of picture sheets 30, which may be placed on the top of one of accumulations of the pictures 31, are formed in a manner of allowing a photograph 60, which may show a user alone or with user's family or friends, to be attached thereonto.

One or more of the pictures 31 include a photograph attachment representation 32 to indicate a position at which the photograph 60 is inserted thereinto or attached thereto by an adhesive in the front or back position of the picture.

At the step of preparing the sticker sheet 40, the sticker sheet 40 includes a releasable sheet 42 attached to each of both surfaces thereof, and is punched to provide the stickers 41 to mediate the pictures 31 to be accumulated on the draft 21 of the draft sheet 20 with predetermined heights.

Herein, the stickers 41 are formed with at least two or three sizes corresponding to the sizes of both the draft 21 and the pictures 31.

This is because, when the draft 21 or the pictures 31 are formed in small sizes, but the stickers 41 are larger in sizes, the large stickers 41 cover the small draft 21 or the small pictures 31 and spoil the appearance of the pictures 31.

Preferably, the stickers are formed with a circular shape to harmonize with the draft 21 and the pictures 31, borders of which mainly have curved lines, thereby effectively executing the three-dimensional stacking of the pictures 31.

In addition, a plurality of representations 50 are provided on both the draft 21 of the draft sheet 20 and the pictures 31, each of which indicates a position at which each of the stickers 41 is attached. Each of the plurality of representations 50 is expressed as a concentric circle in an identical number to that of the stickers 41 needed, thereby allowing a beginner or a child to easily understand the assembly process of the adornment of the present invention.

For example, when the representations 50 have a single concentric circle, one sticker 41 is adhered to the position. When the representations 50 have two concentric circles, two stickers 41 are adhered to the representations 50 in a manner of being stacked.

Herein, the representations 50 expressed as the concentric circles are also formed with different sizes according to the sizes of both the draft 21 and the pictures 31. Preferably, the representations 50 are formed with identical sizes to those of the stickers 41 to facilitate the attachment of the stickers 41 by applying the stickers 41 with identical sizes to those of the representations 50 to the positions with the representations 50.

Figure 5:
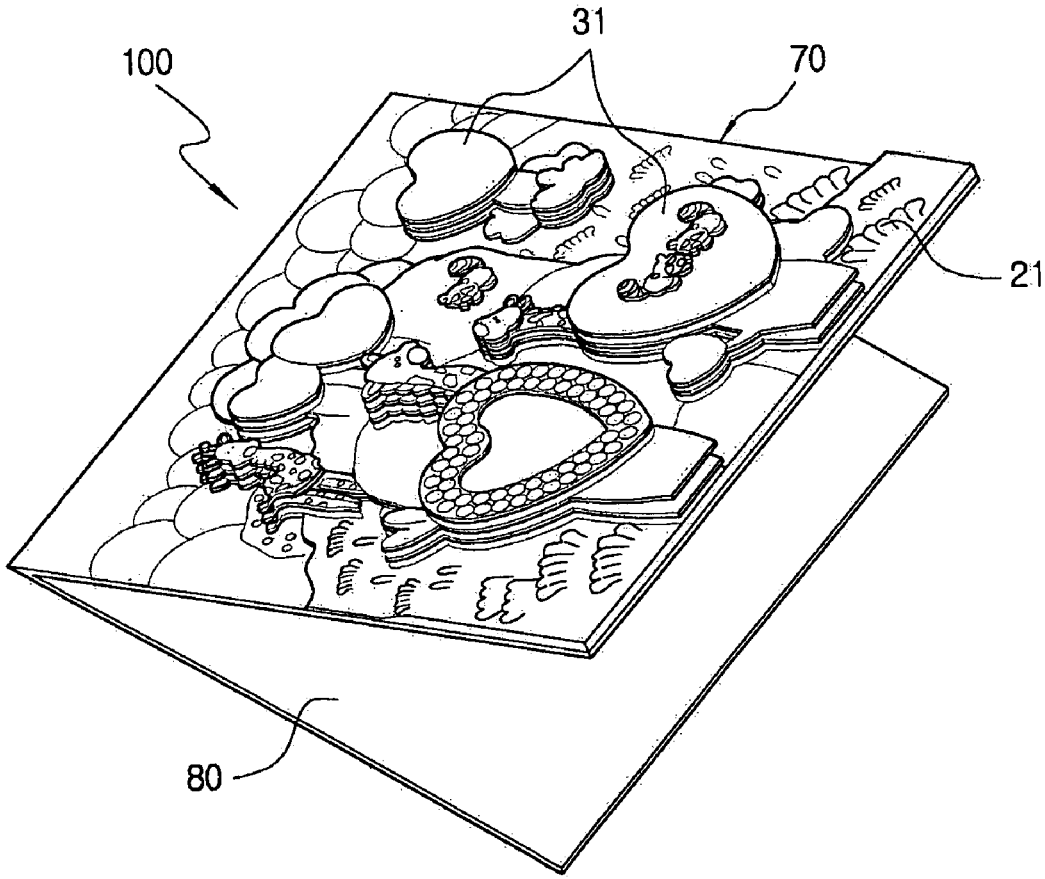
FIG. 5 is a perspective view of an adornment for photograph or picture display according to another embodiment of the present invention.

FIG. 5 illustrates an adornment for photograph or picture display according to another embodiment of the present invention. The adornment for photograph or picture display is provided in a form of a greeting card 100 that is composed of a sheet with a predetermined size and a surface of which is divided into two parts. The card 100 includes: a draft part 70 provided on one of the two parts of the sheet and including a draft 21; a plurality of pictures 31 with various figures and shapes to be three-dimensionally accumulated on the draft 70; and a message writing part 80 provided on another part of the sheet to write a congratulatory or commemorative message thereon.

The adornment for photograph or picture display according to the present invention, which includes the draft sheet 20 including the draft 21, the plurality of picture sheets 30 and a sticker sheet 40, is supplied to a consumer with a description.

When a consumer purchases the adornment for photograph or picture display to display a family photograph or picture or a baby photograph, the consumer, along with his/her children according to the accompanying description, detaches the stickers 41 from the sticker sheet 40 including releasable papers on both surfaces thereof, and, using the stickers 41, attaches the pictures 31 of the picture sheets 30 to the representations 50 provided on the draft 21 of the draft sheet 20 and accumulates the pictures 31 on the draft 21 while matching the draft 21.

Figure 3A:
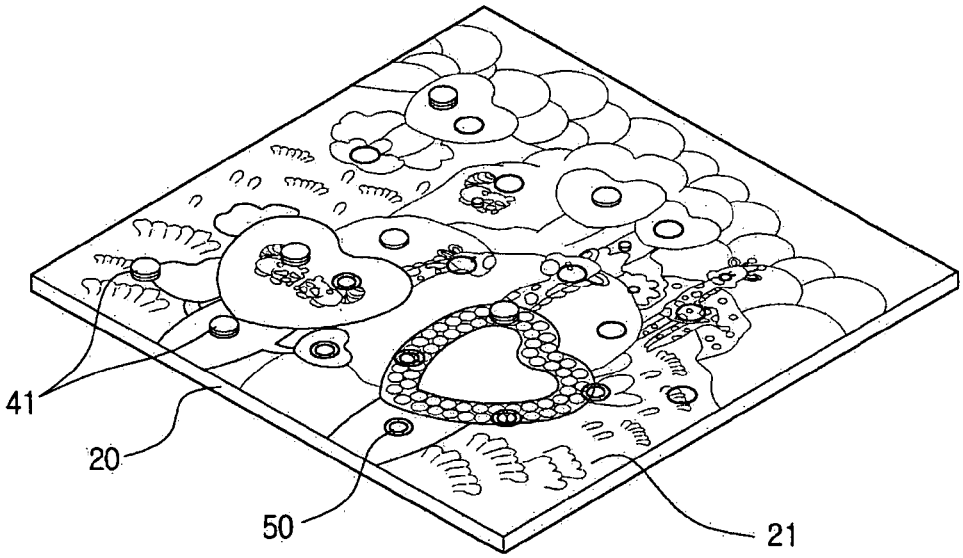
FIGS. 3*a* to 3*e* are perspective views of the adornment according to the present invention, in which an assembly process of the adornment is shown.

In more detail, as shown in FIG. 3*a*, when the stickers 41 of the sticker sheet 40 are attached to the representations 50 provided on the draft 21 of the draft sheet 20, the number of the used stickers 41 is determined according to the number of the concentric circles of the representations 50.

For example, when the representations 50 have a single concentric circle, one sticker 41 is adhered to the position. When the representations 50 have two concentric circles, two stickers 41 are adhered to the position in a manner of being stacked.

Figure 3B:
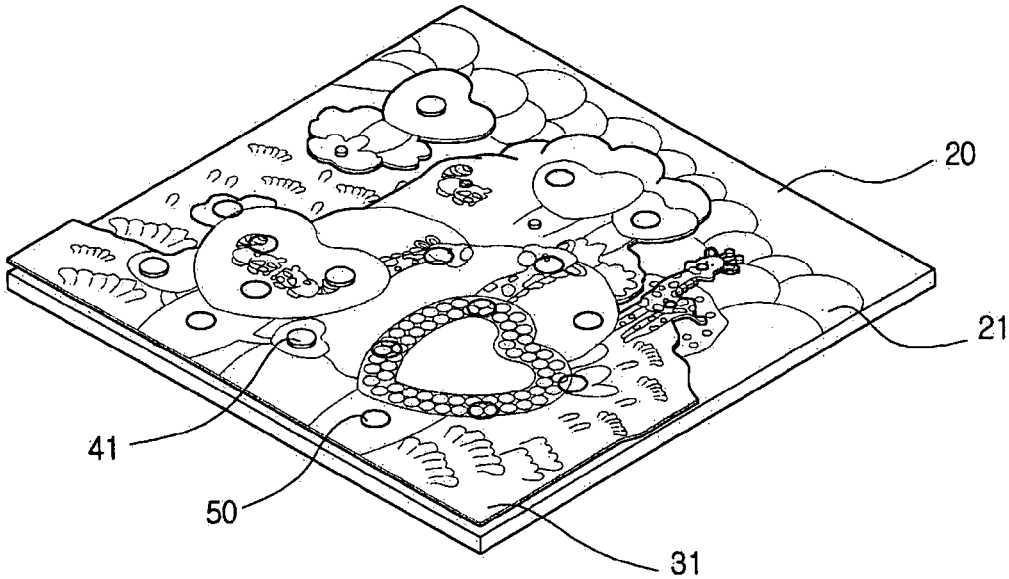

After the stickers 41 are completely attached to the representations 50 of the draft 21, as shown in FIG. 3*b*, the pictures 31 are detached from a first one of the plurality of the picture sheets 30 and attached to the stickers 41 mounted on the representations 50 in such a way of matching the draft 21 of the draft sheet 20. Herein, the attachment of the pictures 31 is easily and simply executed by using the pictures 31 having corresponding numbers to the attachment number representations of the draft 21.

Figure 3C:
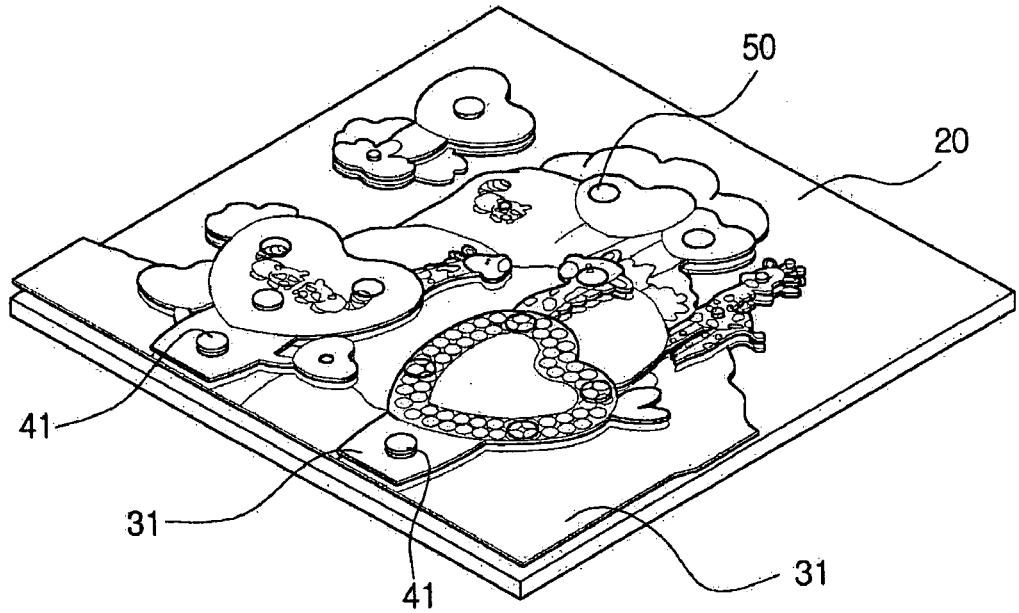

The pictures 31 are accumulated on the draft 21 with different heights according to the stacked degrees of the stickers 41 attached to the draft 21 of the draft sheet 20. Then, as shown in FIG. 3*c*, to the representations 50 provided on the pictures 31 attached to the stacks of the stickers 41, the stickers 41 are attached, and the pictures 31 are detached from a second one of the plurality of picture sheets 30 and attached onto the previously mounted stickers 41, according to the same method as in the first attachment.

Figure 3D:
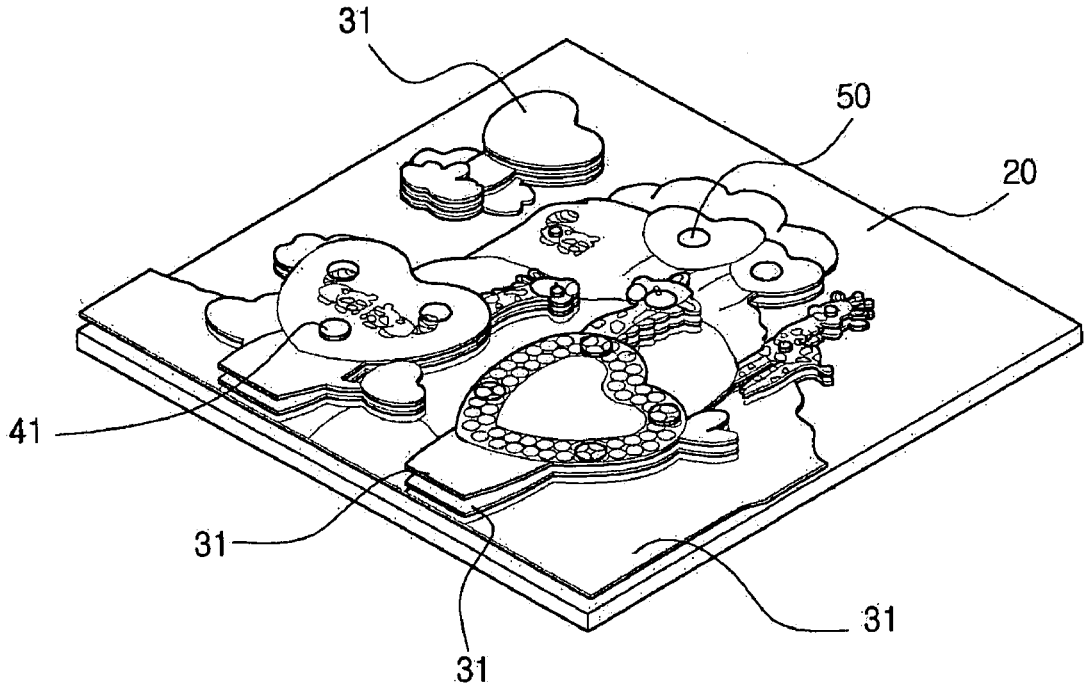
Figure 3E:
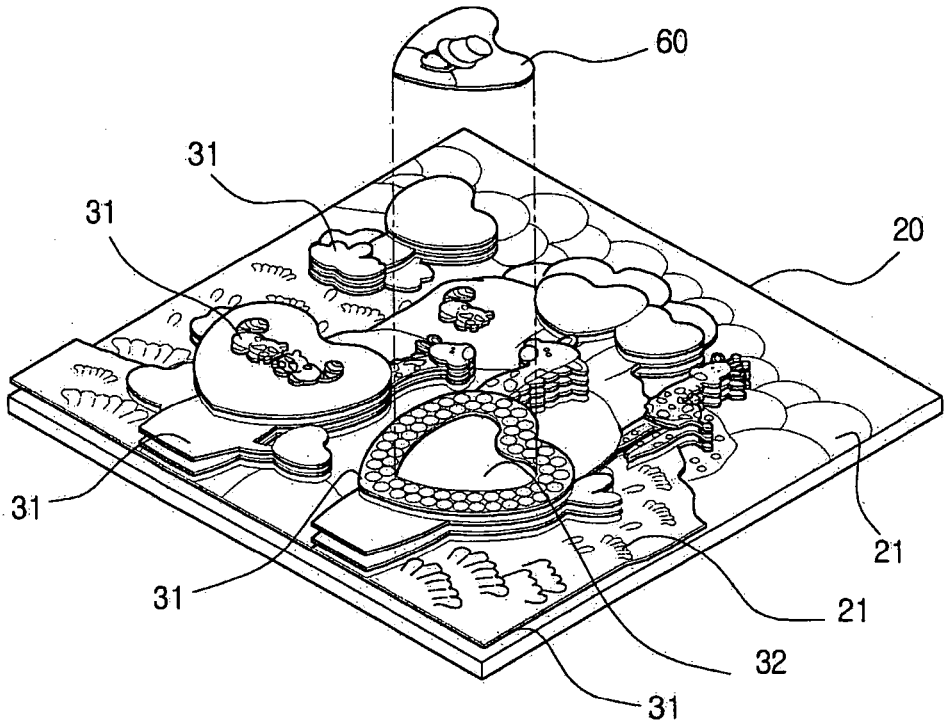
Figure 4:
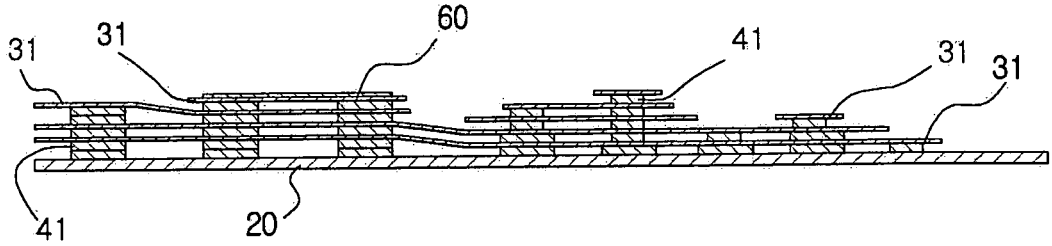
FIG. 4 is a sectional view of the adornment according to an embodiment of the present invention.

Subsequently, when the pictures 31 of the second one of the plurality of picture sheets 30 have the representations 50, the stickers 41 are attached to the representations 50, and, as shown in FIG. 3*d*, the pictures 31 are detached from a third one of the plurality of picture sheets 30 and attached to stacks of the stickers 41. In addition, when the pictures 31 of the third one of the plurality of picture sheets 30 have the representations 50, the stickers 41 are attached to the representations 50, and, as shown in FIG. 3*e*, the pictures 31 are detached from a fourth one of the plurality of picture sheets 30 and attached to stacks of the stickers 41.

Herein, when the pictures 31 do not have the representation 50, the stickers do not need to be attached thereto, and, thus, the accumulation of the pictures 31 is stopped. Therefore, the pictures 31 form three-dimensional accumulations with different heights on the draft sheet 20.

A photograph 60, which may show a user alone or with user's family or friends, is attached to the photograph attachment representation 32 provided on one of the pictures 31 stacked with different heights. The picture including the photograph attachment representation 32 is provided on a top picture of a highest or lowest stack of the pictures 31.

The adornment completely assembled as described above may be placed on a table at an intact state, or inserted into a frame for use as a photograph or picture frame.

Furthermore, the adornment for photograph or picture display of the present invention may be provided in the form of a card that is composed of a sheet which is divided into two parts, with a draft part provided on one of the two parts of the sheet and including a draft, a plurality of pictures three-dimensionally accumulated on the draft using stickers, and a message writing part provided on another part of the sheet to write a congratulatory or commemorative message thereon.

As described hereinbefore, the present invention provides an adornment for photograph or picture display, including a draft sheet including a draft drawn on a back plate, a plurality of picture sheets including pictures corresponding to the draft, and a sticker sheet including stickers. The adornment allows a photograph or picture to be displayed in a three-dimensional beautiful space by three-dimensionally stacking the pictures on the draft sheet and attaching the photograph or picture to a top one of the highest or lowest stacks of the pictures. In addition, due to its easy and convenient assembly, the adornment allows any one, especially, a child, to easily achieve three-dimensional and beautiful display of photographs or pictures. Therefore, the adornment has the educational effect of developing children's ability to display themselves photographs or pictures.

What is claimed is:

1. An adornment for photograph or picture display, comprising:

a draft sheet including a draft with various figures, shapes and colors on a back plate with a predetermined size;

a plurality of picture sheets each including a plurality of pictures with various figures and shapes to be three-dimensionally accumulated on the draft of the draft sheet;

a sticker sheet including a releasable sheet attached to each of both surfaces thereof and a plurality of stickers with various sizes to mediate accumulation of the plurality of pictures on the draft of the draft sheet with predetermined heights;

a plurality of representations provided on both the draft of the draft sheet and the pictures of the plurality of picture sheets, each of which indicates a position at which each of the stickers is attached; and attachment number representations individually provided on each of the pictures and having an identical serial number to that on the draft, thus allowing each of the pictures to be attached to the draft in such a way that each of the pictures matches the draft.

* * * * *